US007658172B2

(12) United States Patent
Tanabe et al.

(10) Patent No.: US 7,658,172 B2
(45) Date of Patent: Feb. 9, 2010

(54) VALVE UNIT OF INTERNAL COMBUSTION ENGINE

(75) Inventors: Mikio Tanabe, Obu (JP); Shinichi Murata, Okazaki (JP); Hitoshi Toda, Okazaki (JP); Masashi Igarashi, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/978,576

(22) Filed: Oct. 30, 2007

(65) Prior Publication Data

US 2008/0098970 A1 May 1, 2008

(30) Foreign Application Priority Data

Oct. 31, 2006 (JP) ..... 2006-297044

(51) Int. Cl.
*F01L 1/34* (2006.01)

(52) U.S. Cl. ..... 123/90.16; 123/90.44

(58) Field of Classification Search ..... 123/90.15, 123/90.16, 90.17, 90.18, 90.39, 90.44, 90.27, 123/90.31; 74/559, 567, 569
See application file for complete search history.

(56) References Cited

U.S. PATENT DOCUMENTS

2005/0161011 A1 7/2005 Fujii et al.
2005/0274340 A1 12/2005 Murata
2006/0249109 A1 11/2006 Ezaki et al.

FOREIGN PATENT DOCUMENTS

| | | | |
|---|---|---|---|
| DE | 20317384 | U1 | 2/2004 |
| EP | 1548240 | A1 | 6/2005 |
| EP | 1707765 | A1 | 10/2006 |
| EP | 1710402 | A1 | 10/2006 |
| JP | 11-81942 | | 3/1998 |
| JP | 11-210434 | | 8/1999 |
| JP | 2001-107713 | | 4/2001 |
| JP | 2003-027973 | | 1/2003 |
| JP | 2005-273507 | | 10/2005 |
| JP | 2005-299536 | A | 10/2005 |
| JP | 2005-299538 | A | 10/2005 |
| JP | 2005-315183 | | 11/2005 |

*Primary Examiner*—Ching Chang
(74) *Attorney, Agent, or Firm*—Birch, Stewart, Kolasch & Birch, LLP

(57) ABSTRACT

A valve unit of an internal combustion engine is accommodated in a space between a cylinder head and a rocker cover. The valve unit comprises a camshaft, a variable valve operating mechanism, a sensor, and a retaining member. The camshaft is provided with a cam for each cylinder. The variable valve operating mechanism receives a displacement of the cam, outputs a valve drive output, and continuously variable-controls the valve drive output in accordance with a rotational displacement of a control shaft provided substantially in parallel with the camshaft. The sensor detects the rotational displacement of the control shaft. The retaining member retains the camshaft, the variable valve operating mechanism, and the sensor. The retaining member expose the sensor to the out side of the rocker cover thereby to fix the camshaft, the variable valve operating mechanism, and the sensor to the cylinder head.

5 Claims, 8 Drawing Sheets

VALVE UNIT OF INTERNAL COMBUSTION ENGINE

CROSS-REFERENCE TO RELATED APPLICATIONS

This application is based upon and claims the benefit of priority from prior Japanese Patent Application No. 2006-297044, filed Oct. 31, 2006, the entire contents of which are incorporated herein by reference.

BACKGROUND OF THE INVENTION

1. Field of the Invention

The present invention relates to a valve unit of an internal combustion engine in which a valve characteristic of an intake valve or an exhaust valve is continuously controlled.

2. Description of the Related Art

In a valve unit of a multicylinder reciprocating engine (internal combustion engine) mounted on an automobile, in order to reduce fuel consumption by exhaust gas measures or by improving pumping loss, a variable valve in which a characteristic of an intake valve (or an exhaust valve) is continuously and variably controlled is incorporated in a head part of a cylinder head covered with a rocker cover.

In most variable valve units, a structure is used in which a characteristic of an intake valve, e.g., an opening/closing timing or a valve lift amount is continuously varied by a rotational displacement of a control shaft received from a cam. A variable valve unit of this type is disclosed in Jpn. Pat. Appln. KOKAI Publication No. 2005-299536.

In most methods of installing such a variable valve unit, a method is used in which, a cylinder head is mounted on a cylinder block on a main line for assembling engines, and each part of the variable valve unit is attached to each corresponding section of the cylinder head, thereby assembling the entire variable valve unit.

In recent times, in order to increase production efficiency of the main line, on the main line, work in which only camshafts and valves are attached to a cylinder head is performed. On a sub-line separate from the main line, a method is used in which a variable valve unit constituting a part of a cylinder head from a camshaft to a valve is modularized.

That is, only the variable valve unit, which is troublesome in assembly, is modularized on the sub-line, the modularized variable valve unit is returned to the main line, and the variable valve unit is attached to a cylinder head (which is already equipped with camshafts and valves). By doing so, a measure is used in which a working process taking much time is reduced on the main line. Assembling methods of such a type are disclosed in Jpn. Pat. Appln. KOKAI Publication No. 2005-299536 and Jpn. Pat. Appln. KOKAI Publication No. 2005-299538.

Incidentally, the variable valve unit is required to continuously control valves of cylinders in accordance with the same valve characteristic so that a set performance can be exhibited in any operational state of an engine. For that purpose, the variable valve unit is required to undergo adjustment work for adjusting a valve drive output in accordance with a cam profile of each cam for each cylinder, thereby eliminating variation between cylinders.

However, in the above adjustment for eliminating variation between cylinders, troublesome and considerably time-consuming fine adjustment work for making relationships between cams and parts of the variable valve unit for receiving the cams with respect to the respective cylinders so that the continuously variable valve characteristic can be appropriately exhibited is required.

Particularly, in the technique disclosed in Jpn. Pat. Appln. KOKAI Publication No. 2005-299536, a contrivance is employed in which an adjustment mechanism is incorporated in the variable valve unit, the adjustment mechanism having a structure in which a position of a part for receiving a cam is made adjustable, thereby facilitating the adjustment work. For this reason, the adjustment work can be performed only after the variable valve unit provided with parts for receiving cams of a camshaft is attached to the cylinder head provided with camshafts. Therefore, on the main line for assembling engines, considerably time-consuming adjustment work (adjustment for eliminating variation between cylinders) is still required, which is a factor for causing stagnation of the main line.

Furthermore, in the adjustment for eliminating variation between cylinders, not only simply making positional relationships between cams and parts for receiving the cams uniform, but also making uniform the valve characteristics on the basis of the continuously variable control shaft is needed. Accordingly, work for attaching a sensor for detecting a rotational displacement of the control shaft, and work for adjusting the sensor is required on the main line. Such work is also a factor causing stagnation of the main line. Particularly, the sensor is an important part for continuously and variably controlling the valve characteristic. Therefore, the attaching of the sensor must be performed in consideration of maintenance because maintenance of the sensor is required in a state where the assembly of the engine is finished or after the engine is completed as a product. Considering these requirements, considerably difficult problems must be solved to eliminate the stagnation of the main line.

BRIEF SUMMARY OF THE INVENTION

An object of the present invention is to provide a valve unit of an internal combustion engine that can improve the productivity of the internal combustion engine.

The valve unit of the present invention comprises: a camshaft provided with a cam for each cylinder; a variable valve operating mechanism for receiving a displacement of the cam, outputting a valve drive output, and continuously variable-controlling the valve drive output in accordance with a rotational displacement of a control shaft provided substantially in parallel with the camshaft; a sensor for detecting the rotational displacement of the control shaft; and a retaining member for retaining the camshaft, the variable valve operating mechanism, and the sensor, wherein the sensor is exposed to the outside of the rocker cover, thereby fixing the camshaft, the variable valve operating mechanism, and the sensor to the cylinder head through the retaining member.

That is, in the valve unit, the camshaft and the sensor are also combined with the valve unit, and hence the valve unit becomes a structure in which cylinder-to-cylinder variation can be adjusted singly. In other words, unlike the conventional case, it is possible not only to complete the assembly of the valve unit on a line separate from the line for assembling internal combustion engines but also to perform adjustment of cylinder-to-cylinder variation, e.g., adjustment of cylinder-to-cylinder variation using a simulation system in which a cylinder head of an internal combustion engine is simulated. Accordingly, the work required on the main line is only work for attaching a valve unit, for which adjustment has already been finished, to a cylinder head on the main line. The cylinder-to-cylinder variation adjustment work and the troublesome work for attaching the sensor and adjusting the sensor, which become factors causing stagnation on the main line, are made unnecessary. Furthermore, the sensor is attached to the cylinder head in a state where it is arranged outside the rocker cover, and hence maintenance thereof can be facilitated.

In a desirable aspect of the present invention, a configuration including an adjustment mechanism capable of adjusting the valve drive output for each cylinder is employed in the variable valve operating mechanism.

In another desirable aspect of the present invention, the configuration is made such that a sensor for detecting the rotational displacement is arranged at an axial end of the control shaft, and the other end of the control shaft is coupled to an actuator mechanism for rotationally displacing the control shaft.

In another desirable aspect of the present invention, the retaining member comprises a holder member for holding one side of the camshaft in the diametric direction, the variable valve operating mechanism, and the sensor, a cap member for holding remaining one side of the camshaft, and a fixing bolt member which penetrate the holder member and the cap member, and can be screwed into the cylinder head.

In a further desirable aspect of the present invention, the Plurality of retaining members are provided so as to axis-support at least both ends of the camshaft and the control shaft, and the retaining members are connected to each other by the camshaft and the control shaft.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
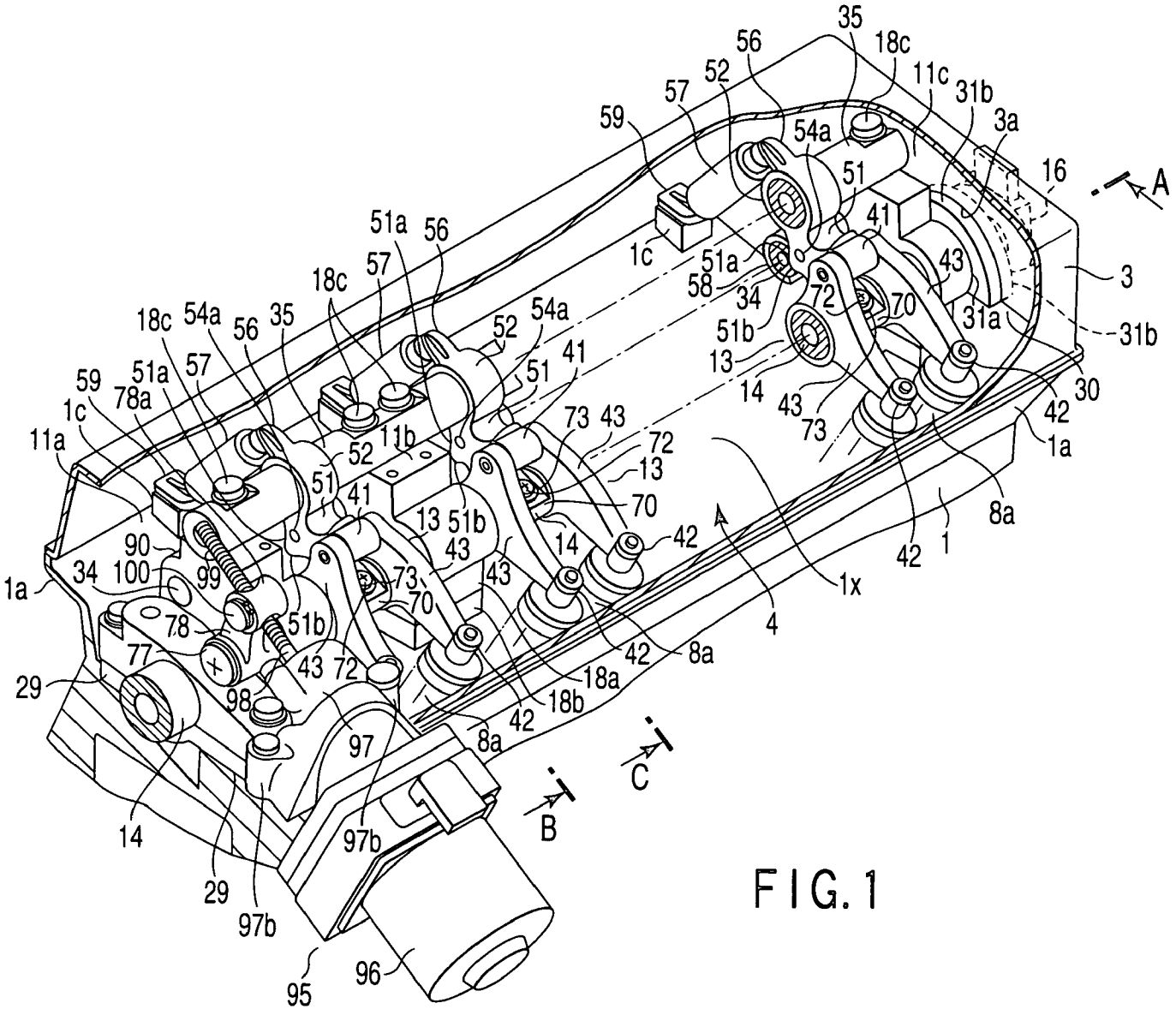
FIG. 1 is a partial cutaway perspective view showing a cylinder head of an internal combustion engine according to an embodiment of the present invention together with a valve unit mounted on the cylinder head.
Figure 2:
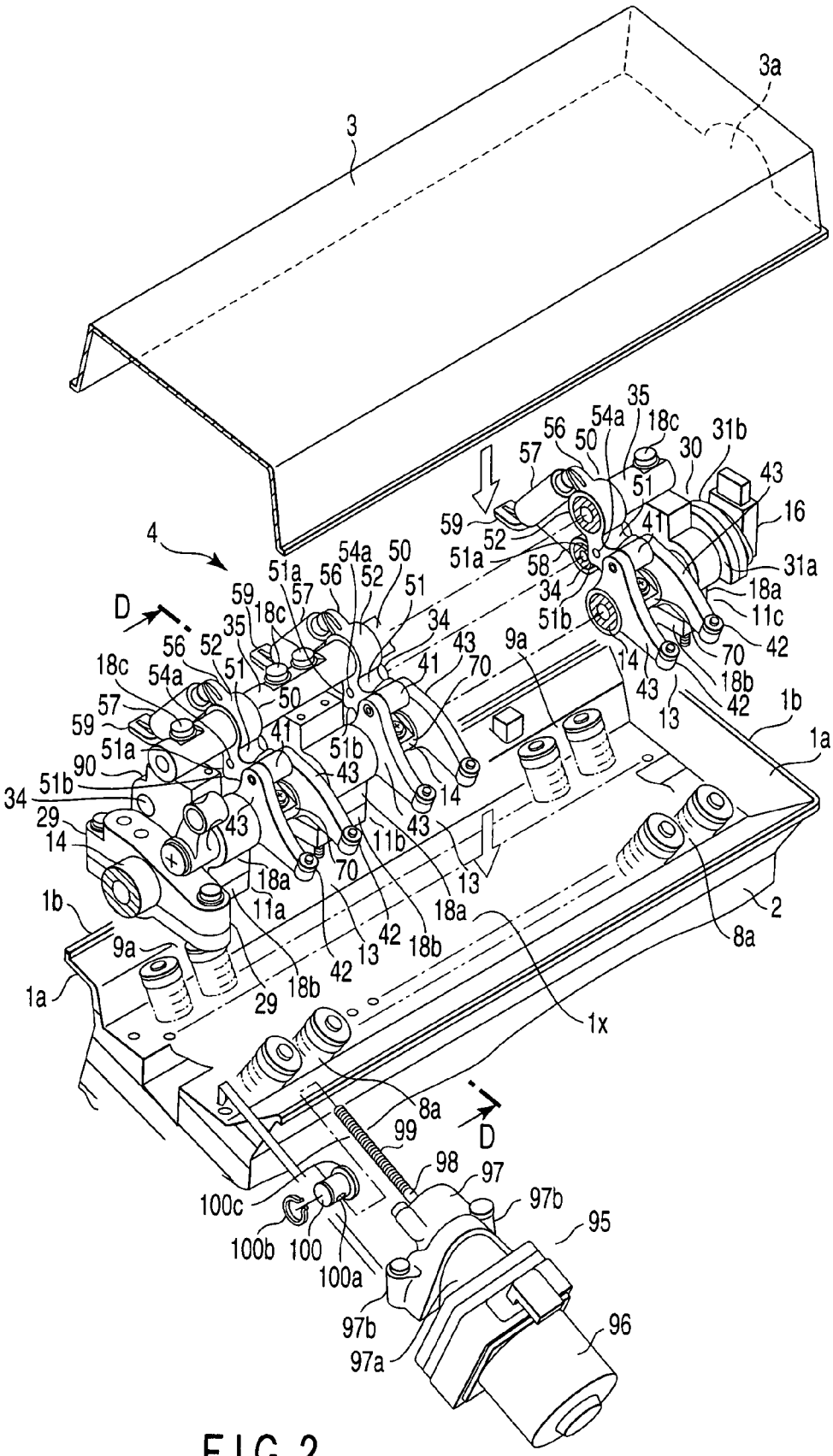
FIG. 2 is an exploded perspective view showing the modularized variable valve unit together with peripheral units and devices.

A variable valve unit of an internal combustion engine according to a first embodiment of the present invention will be described below with reference to FIGS. 1 to 7. FIG. 1 shows a perspective view of a head part of an engine main body in a reciprocating inline four-cylinder petrol engine, which is an example of a multicylinder internal combustion engine. FIG. 2 is a perspective view showing a state where the head part is disassembled. FIGS. 4 to 7 are cross-sectional views respectively showing states where respective parts (cross sections taken along lines A, B, and-C in FIG. 1, and line D-D in FIG. 2) are cross-sectioned.

Figure 5:
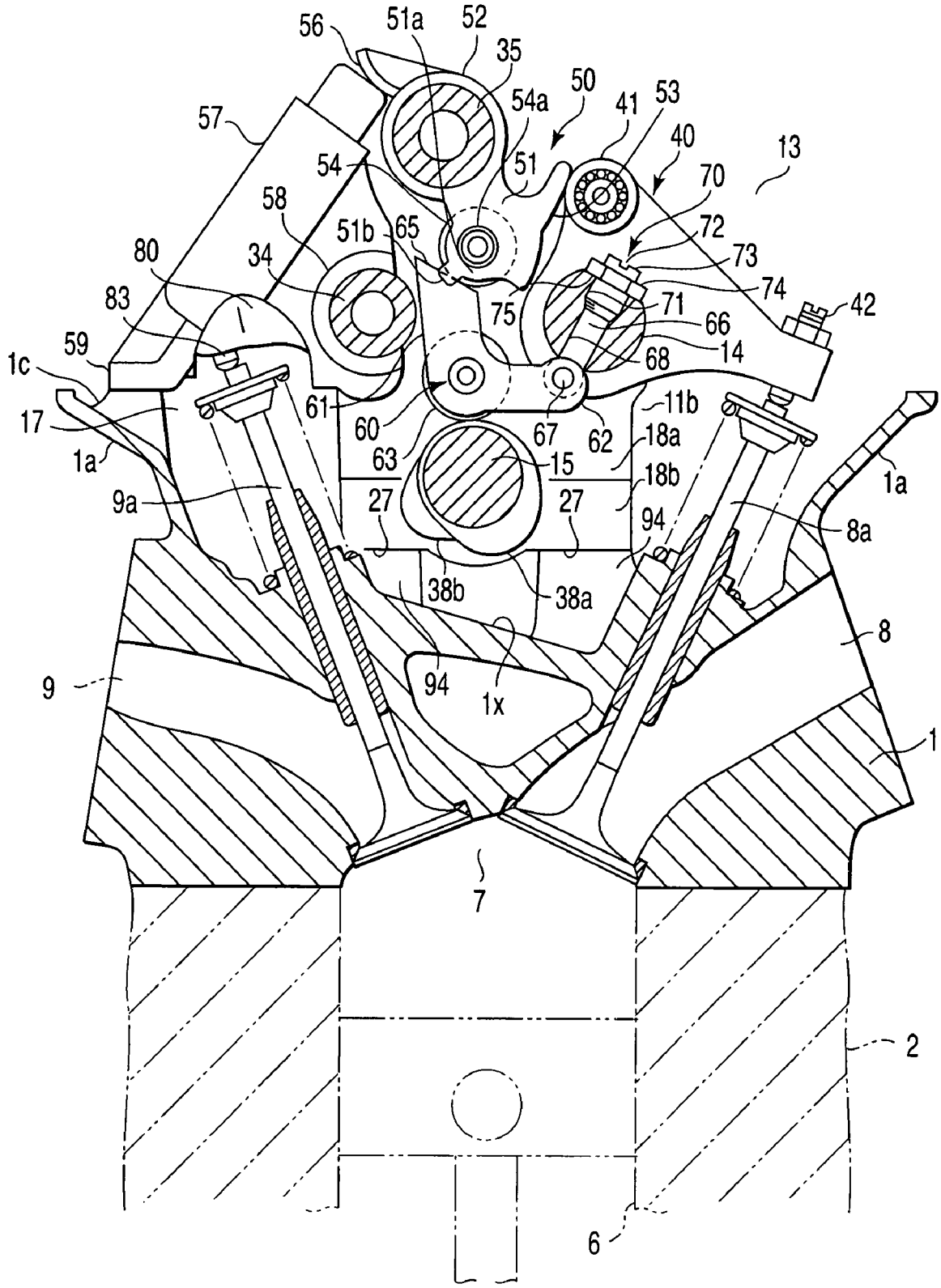
FIG. 5 is a cross-sectional view around the cylinder head taken along line B indicated by an arrow B in FIG. 1.

A reference numeral 1 in FIG. 1 denotes a cylinder head mounted on a head part of a cylinder block 2 (shown in only FIG. 5 by two-dot chain lines). A reference numeral 3 denotes a rocker cover covering an upper part of the cylinder head 1. A reference numeral 4 denotes SOHC type variable valve unit which is in a space between the cylinder head 2 and the rocker cover 3. The variable valve unit 4 is an example of a valve unit of the present invention.

Figure 6:
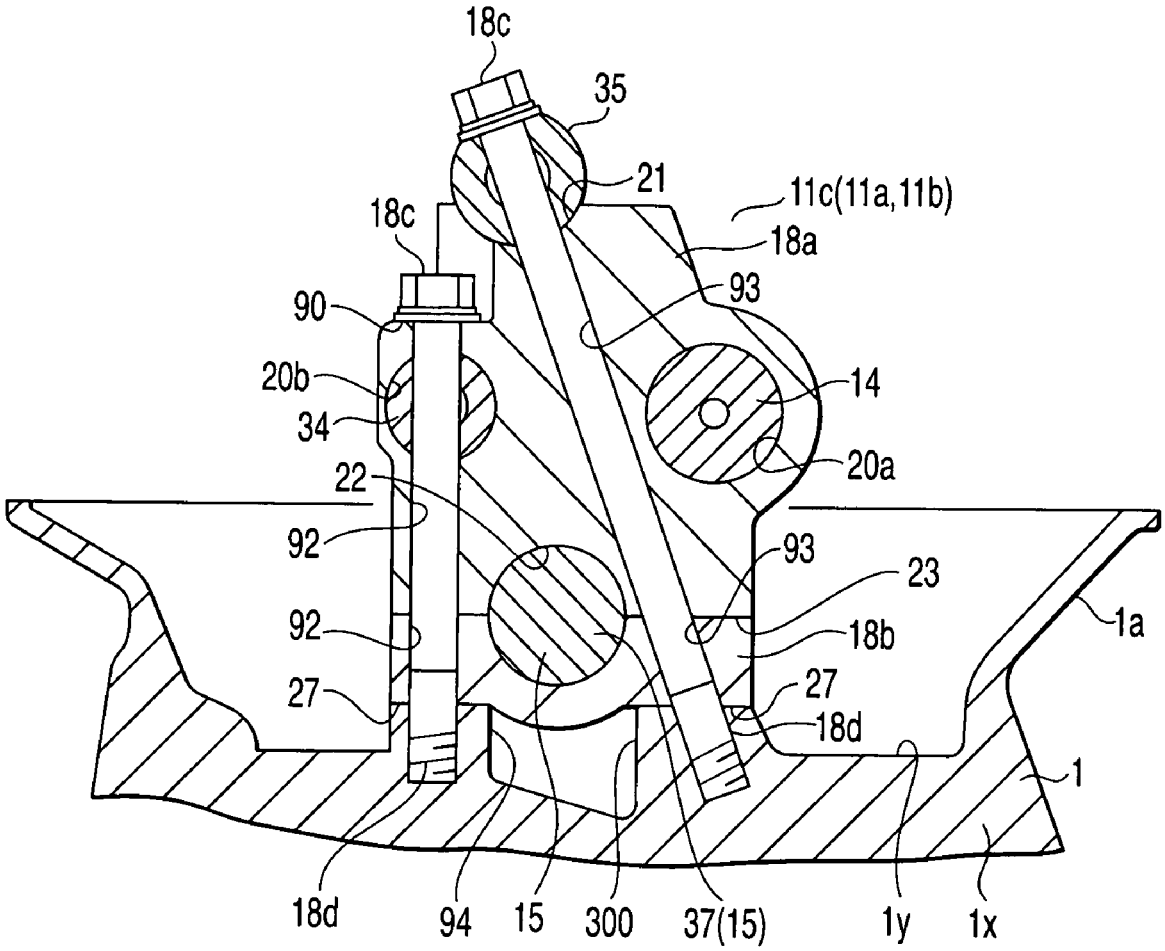
FIG. 6 is a cross-sectional view around the cylinder head taken along line C indicated by an arrow B in FIG. 1.

The cylinder head 1 is provided with a head main body 1*x*. As shown in FIGS. 1, 2, and 5, the head main body 1*x* is surrounded by a peripheral wall 1*a* at an upper part thereof. A top surface 1*y* of the head main body 1*x* is made lower than a rocker cover attaching seat 1*b* formed at an upper end part of the peripheral wall 1*a* as shown in FIGS. 5 and 6.

Combustion chambers 7 (shown in only FIG. 5) are formed on an undersurface of the head main body 1*x* so as to correspond to four cylinders 6 (shown by two-dot chain lines in only FIG. 5) formed in the cylinder block 2. A pair of intake ports 8 and a pair of exhaust ports 9 (both of which are shown in a part of FIG. 5) which extend from the combustion chamber 7 are formed on both sides (in the width direction) of the head main body 1*x*.

To the intake ports 8 of these ports, a pair of normally-closed intake valves 8*a* are attached. A pair of normally-closed exhaust valves 9*a* are attached to the exhaust ports 9. Stem ends of the valves 8*a* and 9*a* protrude upwardly from the top surface 1*y* of the head main body 1*x*. Incidentally, for example, an ignition plug is attached to each combustion chamber 7, and an injector is attached to each cylinder (both are not shown).

In the variable valve unit 4, a modularized structure in which various parts are assembled is employed. To specifically describe the modularization, as shown in, for example, FIGS. 2 and 5, a variable valve operating mechanism 13 of the intake side having an adjusting function, a control shaft 14 (serving also as a rocker shaft for intake) for controlling the variable valve operating mechanism 13, a camshaft 15, a shaft displacement detection sensor 16 (corresponding to the sensor of the present application) for detecting a rotational displacement of the control shaft 14, and a rocker arm mechanism 17 (only a part thereof is shown in FIG. 5) of the exhaust side are assembled by using a plurality of (five) retaining members 11*a* to 11*c* (only three representative ones are shown).

Structures of respective parts will be described below. The retaining members 11*a* to 11*c* are, as shown in FIGS. 1 and 2, parts each having a wall-shape divided in accordance with an arrangement of each of the cylinders 6 (four), and arranged at the foremost part of the cylinder array, between the cylinders, and at the backmost part in parallel with each other. Incidentally, the retaining members may be only the foremost and backmost members in the case of modularization. However, it is desirable that the retaining member be provided between the cylinders in consideration of the rigidity and the like.

Figure 3:
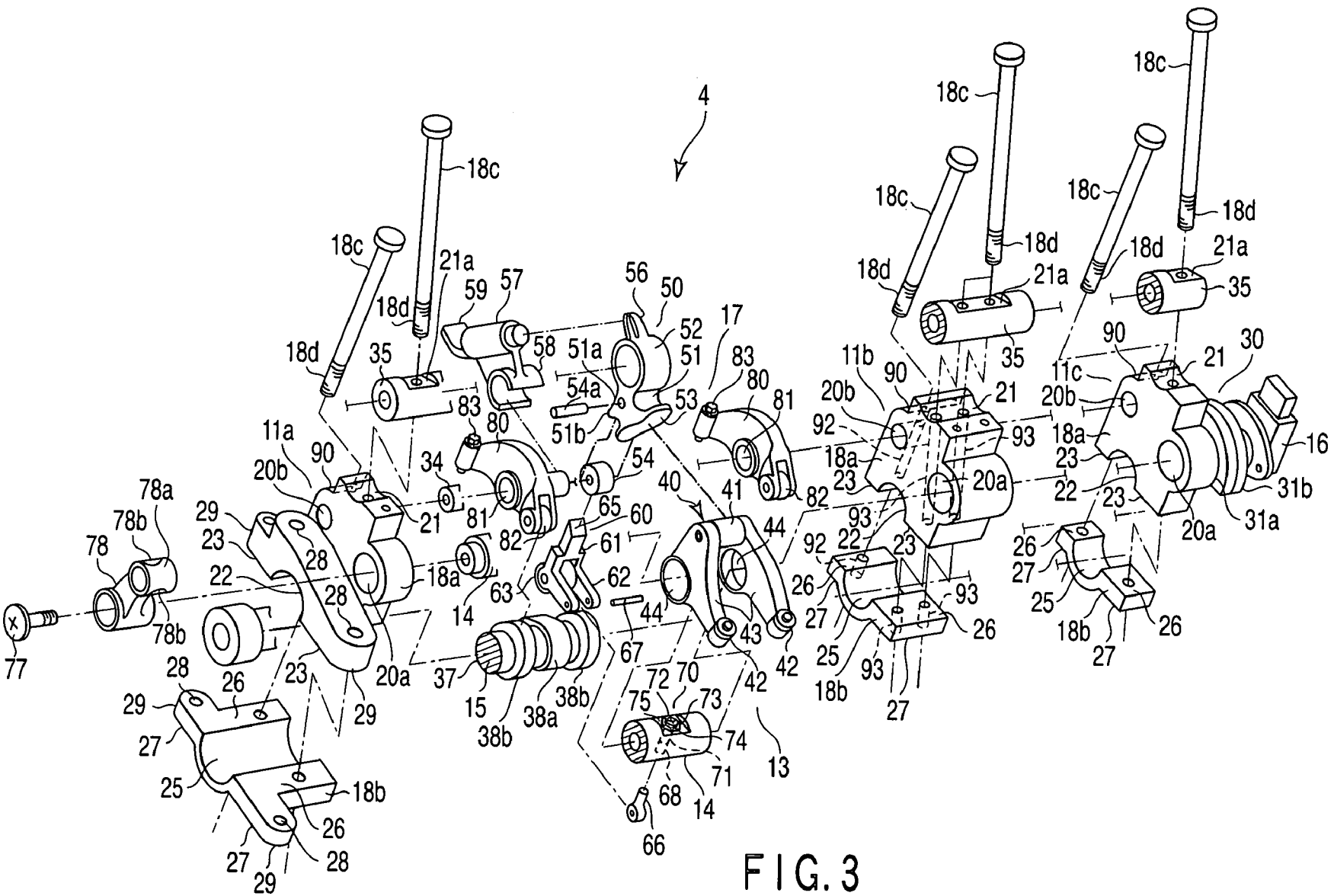
FIG. 3 is an exploded perspective view for explaining structures of parts of the variable valve unit.

As shown in FIG. 3, a two-piece structure provided with a wall-shaped holder member 18*a* extending in the width direction (direction perpendicular to the cylinder array direction) of the cylinder head 1, and a cap member 18*b* to be combined with the holder member 18*a* at a lower end part thereof, and a structure in which a holder member 18*a*, a cap member 18*b*, and a plurality of fixing bolt members 18*c* to be attached to the members 18*a* and 18*b* so as to penetrate the members 18*a* and 18*b* are combined with each other are used for these retaining members 11*a* to 11*c*.

Of the above members, each of the holder members 18*a* has the same structure, and as shown in FIG. 3, an intake rocker shaft retaining hole 20*a* and an exhaust rocker shaft retaining hole 20*b* arranged in the lateral direction with a predetermined interval between them are formed in the middle stage on both sides of each holder member 18*a*. On a top surface of the holder member 18*a*, an arcuate attaching seat 21 is formed at a position between the intake rocker shaft retaining hole 20*a* and the exhaust rocker shaft retaining hole 20*b* and closer to the hole 20*b*. On an undersurface of the holder member 18*a*, a semicircular journal bearing surface 22 is formed at a position between the intake rocker shaft retaining hole 20*a* and the exhaust rocker shaft retaining hole 20*b* and closer to the hole 20*b*. The entire undersurface of the holder member 18*a* except for the bearing surface 22 is used as a cap attaching seat 23.

For example, a plate-like member having an arcuate recession at a central part thereof is used as the cap member 18*b*. A semicircular journal bearing surface 25 is formed at the central part on a top surface of the cap member 18*b*, and the entire top surface except for the bearing surface 25 is used as a cap attaching surface 26. Incidentally, flat undersurface parts on both sides on the undersurface of the cap member 18*b* between which the journal bearing surface 25 is interposed are used as a module installation seat surface 27.

Each of the foremost holder member 18*a* and cap member 18*b* has, unlike the other members, a pair of leg parts 29 formed so as to externally extend on both sides thereof. A journal bearing surface 22, a cap attaching seat 23, a journal bearing surface 25, a cap-attaching surface 26, and a seat surface 27 are also formed on the pairs of the leg parts 29.

Figure 4:
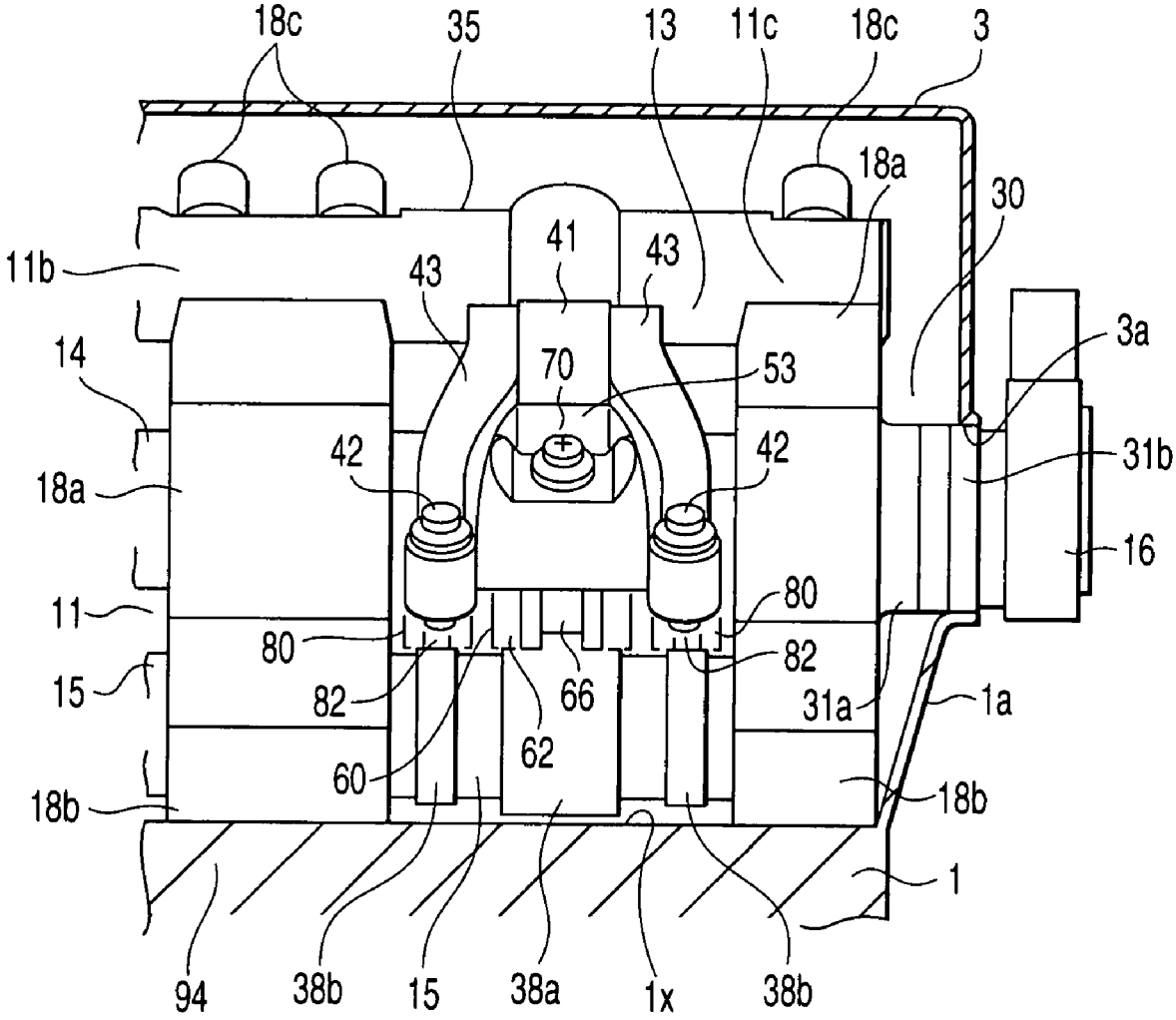
FIG. 4 is a cross-sectional view around a sensor taken along a line indicated by an arrow A in FIG. 1.

Incidentally, through holes 28 in which head bolts (not shown) are inserted are formed in the leg parts 29. A sensor attaching part 30 is formed on the holder member 18*a* arranged at the backmost position. In the sensor attaching part 30, as shown in FIGS. 3 and 4, a structure in which a cylinder part 31*a* extending from the intake rocker shaft retaining hole 20*a* toward the backmost position is formed, and a fan-shaped sensor attaching boss 31*b* is formed at a distal end of the cylinder part 31*a* is employed.

In the respective intake rocker shaft retaining holes 20*a*, as shown in FIGS. 2 and 3, a control shaft 14 (constituted of a hollow member) serving also as the intake side rocker shaft is rotatably inserted so as to allow the shaft 14 to extend from the foremost retaining member 11*a* to the backmost retaining member 11*c*. The exhaust side rocker shaft 34 (constituted of a hollow member) is inserted in the respective exhaust rocker shaft retaining holes 20*b* so as to allow the shaft 34 to extend from the foremost retaining member 11*a* to the backmost retaining member 11*c*. Likewise, a support shaft 35 (constituted of a hollow member) is fitted in the respective attaching seats 21 so as to allow the shaft 35 to extend from the foremost retaining member 11*a* to the backmost retaining member 11*c*.

Likewise, the camshaft 15 is arranged between the respective journal bearing surfaces 22 and the journal bearing surfaces 25 so as to allow the shaft 15 to extend from the foremost retaining member 11*a* to the backmost retaining member 11*c*. A plurality of journals 37 (shown in FIG. 6) formed on the shaft part of the camshaft 15 are received between the journal bearing surfaces 22 and the journal bearing surfaces 25, thereby rotatably supporting the camshaft 15.

Incidentally, each of parts of the camshaft 15 between the respective journals 37 (between the cylinders) includes a cam group constituted of an intake cam 38*a* arranged in the center and (two) exhaust cams 38*b* arranged on both sides.

The variable valve operating mechanism 13 (intake side) is attached to parts of the support shaft and the control shaft between the above-mentioned holder members 18*a*, and the rocker arm mechanism 17 (exhaust side) is attached to parts of the exhaust rocker shaft 34 (for each cylinder).

Here, the respective mechanisms will be described below. As shown in FIGS. 3 and 5, a valve drive mechanism of a type called a swing cam type in which a swing cam 50 is used, for example, a mechanism in which a rocker arm 40, a swing cam 50, and a center rocker arm 60 are combined with each other is used as the variable valve operating mechanism 13.

The above elements will be described below. As the rocker arm 40, the one having a bifurcate arm shape is used. Specifically, the rocker arm 40 is provided with a pair of L-shaped rocker arm pieces 43 having needle rollers 41 rotatably provided between one ends of the pieces 43 and having adjust screw sections 42 serving as valve drive sections provided at the other ends of the pieces 43.

Further, a part of the control shaft 14 between the holder members 18*a* is swingably inserted in a pair of support holes 44 formed in intermediate parts of the respective rocker arm pieces 43. Further, the needle rollers 41 are arranged on the support shaft 35 side, and the pair of adjust screw sections 42 are arranged on the opposite side of the support shaft 35.

As shown in FIGS. 3 and 5, a structure in which a supporting boss 52 having a cylindrical shape is provided at one end of an arm section 51, a cam surface 53 extending in the vertical direction is provided at the other end of the arm section 51, and a slide roller 54 is rotatably embedded in the lower part of the arm section 51 in such a manner that the outer circumferential surface thereof is exposed from the lower side is used for the swing cam 50.

Incidentally, reference numeral 54*a* denotes a shaft member for supporting the slide roller 54. A part of the support shaft 35 between the holder members 18*a* is swingably fitted in the supporting boss 52. As a result of this, the cam surface 53 at the distal end of the arm section 51 is in rolling contact with the needle rollers 41.

A pusher receiving rib 56 is protruded from an upper part of the supporting boss 52. A pusher 57 having, for example, a piston structure is combined with the rib 56 at a lower position of the rib 56 in an inclined posture. This pusher 57 is supported by fitting a C-shaped leg section 58 formed on the side part thereof on a part of the exhaust side rocker shaft 34.

Incidentally, an installation seat 59 is formed at a lower part of the pusher 57. A structure is made such that when the variable valve unit 4 is attached to the cylinder head 1 by means of the installation seat 59, an energizing force is imparted to the swing cam 50 (this is because when the installation seat 59 is provided on the cylinder head 1, the pusher is rotationally displaced using the rocker shaft 34 as a fulcrum).

The center rocker arm 60 is, as shown in FIGS. 3 and 5, constituted of an L-shaped part arranged at a position surrounded by the intake cam 38*a*, slide roller 54, and control shaft 14.

The center rocker arm 60 includes a relaying arm section 61 extending toward the slide roller 54 above, and a fulcrum arm section 62 extending toward a part immediately below a part of the control shaft 14 located at a lateral position.

An inclined surface 65 for controlling the movement of the swing cam 50 is formed on a distal end surface of the relaying arm section 61. This inclined surface is a flat surface having a lower part on the control shaft 14 side and a higher part on the rocker shaft 34 side. Further, a slide roller 63 is supported at an intermediate part at which both the arm sections 61 and 62 intersect each other so as to be rotatable in the same direction as the intake cam 38*a*.

Further, in the relaying arm section 61 interposed between the intake cam 38*a* and the swing cam 50, the slide roller 63 is in rolling contact with the cam surface of the intake cam 38*a*, and the inclined surface 65 of the relaying arm section 61 is bumped against an outer circumferential surface of the slide roller 54 of the swing cam 50. As a result of this, the displacement of the intake cam 38 is transmitted to the swing arm 50 through the relaying arm section 61.

Further, a support pin 66 is flexibly supported on the fulcrum arm section 62 by means of a pin 67. A distal end of the support pin 66 is rotatably inserted in a through hole 68 formed on the lower side of the control shaft 14 in a direction perpendicular to the axial direction, whereby the control shaft 14 is caused to support the center rocker arm 60.

By virtue of this support, when the control shaft is 14 rotationally moved, the rocker arm 60 that swings around the pin 67 (end of the support pin 6) serving as a fulcrum can move in a direction intersecting the camshaft 15 (in the lead angle direction or the lag angle direction) while changing the position at which the rocker arm 60 is in rolling contact with the center intake cam 38*a*.

In this movement, the opening/closing timing and the valve lift amount of the intake valve 8*a* can be simultaneously and continuously varied. That is, the upper part of the cam surface 53 is a base circle section (formed by, for example, an arcuate surface having the axis of the support shaft 35 as a center thereof), and the lower part of the cam surface 53 is a lift section (formed by, for example, an arcuate surface having the same shape as the cam shape of the lift region of the intake cam 38*a*) continuing from the base circle section.

When the slide roller 63 of the center rocker arm 60 moves in the lead angle direction or the lag angle direction of the intake cam 38*a*, the posture of the swing cam 50 is changed, and the region of the cam surface 53 in which the needle rollers 41 move is changed.

In other words, the ratio of the base section to the lift section in which the needle rollers 41 travel is changed. A change in the ratio of the base section to the lift section accompanied by a change in the phase in the lead angle direction and a change in the phase in the lag angle direction continuously changes the valve lift amount of the intake valve 8*a* while largely changing the opening/closing timing of the intake valve 8*a*. In this case, the valve-closed period is more changed than the valve-opened period. This is output from the rocker arm 40 as the valve drive output. At this time, in order to prevent the alignment of the slide roller 54 with the inclined surface 65 from being shifted, a pair of guide walls 51*b* extending from wall sections 51*a* sandwiching the slide roller 54 from both sides (in the width direction) to both sides of the distal end of the relaying arm section 61 bumping against the slide roller 54 are formed on the wall sections 51*a* as shown in FIGS. 3 and 5.

Specifically, the guide walls 51*b* are provided in such a manner that they cover the contact point at which the slide roller 54 of the swinging swing cam 50 and the inclined surface 65 of the center rocker arm 60 are in contact with each other. As a result of this, the center rocker arm 60 is prevented from being shaken around the support pin 66 serving as a fulcrum. To the part of the control shaft 14 in which the support pin 66 is inserted, an adjustment mechanism 70 is attached as shown in FIGS. 3 and 5. In the adjustment mechanism 70, a structure is employed in which a threaded hole 71 continuing from the through hole 68 and opening upwardly is formed at, for example, the part of the control shaft 14, and, for example, a screw member 73 having a slot 72 for screw-driving at a head part thereof is screwed into the threaded hole 71 so that it can be advanced or retreated.

In other words, the adjustment mechanism 70 has a structure in which the protrusion amount of the support pin 66 is changed by a rotating operation of the screw member 73, whereby the rolling contact position of the slide roller 63 is changed. Further, a change in the rolling contact position of the slide roller 63 changes the posture of the center rocker arm 60 and the posture of the swing cam 50, thereby adjusting the valve opening/closing timing and the valve lift amount (each of which is a valve characteristic). The screw member 73 is locked by a locknut 74. Incidentally, a reference numeral 75 denotes a notch forming a seat surface of the lock nut 74.

A proximal end part of an arm member 78 extending in the radial direction of the control shaft 14, i.e., in this case, extending upwardly is fixed (by a screw) to an end of the control shaft 14 protruding from the foremost holder member 18*a* by means of, for example, a screw member 77 as shown in FIGS. 2 and 3. Rotational movement necessary for continuous control of the valve characteristic is input from the end of the arm member 78.

In the rocker arm mechanism 17 (exhaust side), a structure is employed in which a pair of rocker arms 80 are rotatably assembled on both sides of the leg section 58 of the pusher 57 at a part of the rocker shaft 34, as shown in FIGS. 3 and 5.

Specifically, each of the rocker arms 80 has a support hole 81 at an intermediate part thereof, has a roller member 82 serving as a contact piece at an end thereof, and has an adjusting screw section 83 serving as a valve drive section at the other end thereof.

Then, the part of the rocker shaft 34 between the holder member 18*a* and the leg section 58 (pusher 57) is swingably inserted in the support holes 81 of the rocker arms 80. Each of the roller members 82 is arranged on the exhaust cam 38*b* side and the adjust screw section 83 is arranged on the opposite side. That is, each rocker arm 80 is in a state where it can be combined with the exhaust valve 9*a*.

Figure 7:
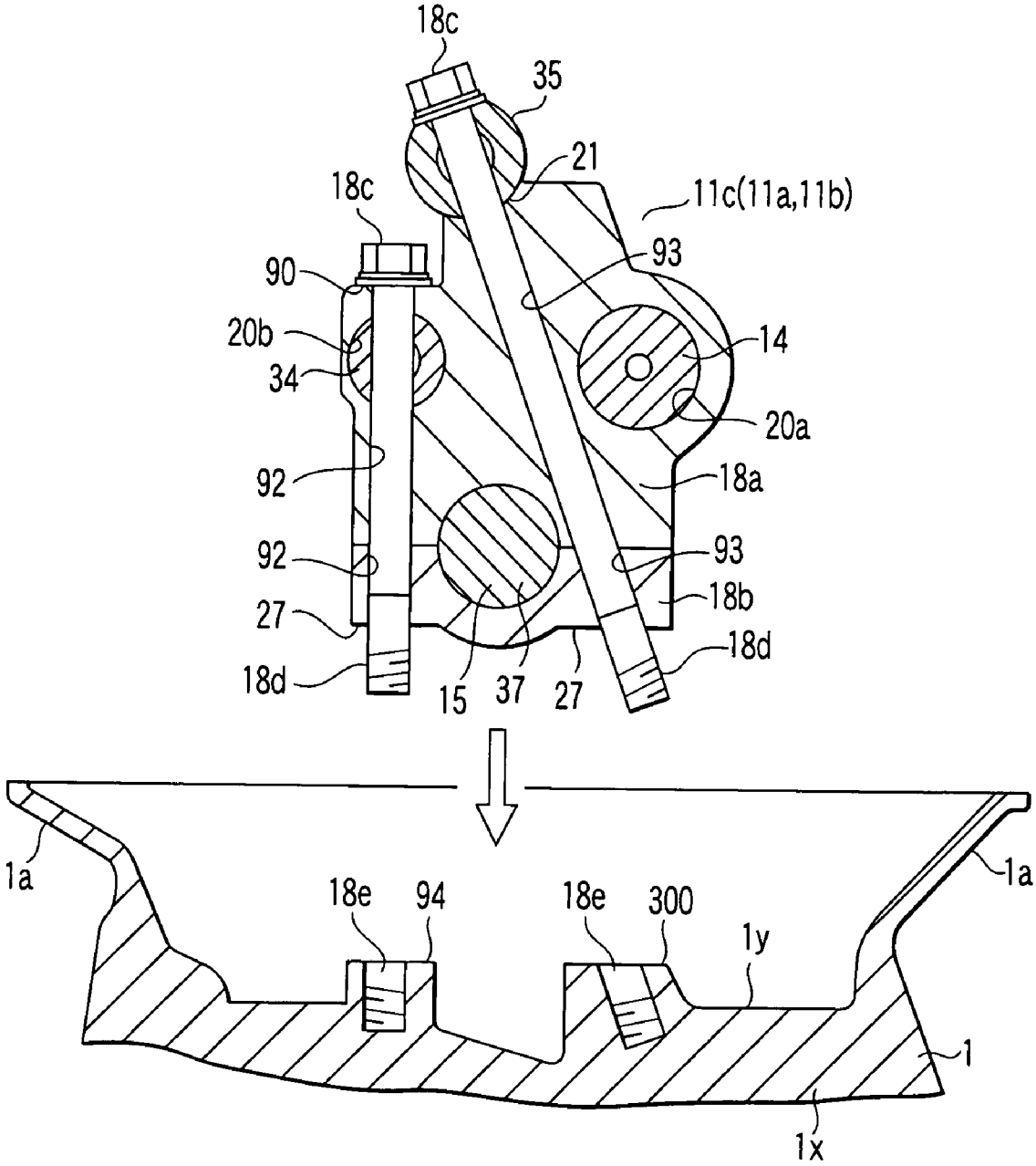
FIG. 7 is a cross-sectional view taken along line D-D in FIG. 2.

As shown in FIGS. 3, 6, and 7, the fixing bolt member 18*c* is inserted from the seat surface 90 formed on the top surface of each holder member 18*a* directly above the rocker shaft 34. The fixing bolt member 18*c* linearly penetrates (skewers) a central part of the rocker shaft 34 in the radial direction, a wall part on the support shaft 35 side (one side of the camshaft 15), the support shaft 35 being adjacent to the camshaft 15, and the cap part of the cap member 18*b* on the rocker shaft 34 side.

The fixing bolt 18*c* is obliquely inserted from each seat surface 21*a* formed in the upper surface of the support shaft 35 arranged at the highest position. As a result of this oblique insertion, the wall part between the rocker shaft 34 and the control shaft 14, the wall part between the camshaft 15 and the control shaft 14, and the cap part of the cap member 18*b* on the control shaft 14 side are obliquely and linearly penetrated (skewered) by the fixing bolt 18*c*.

However, reference numerals 92 and 93 denote bolt insertion holes (only a part of them is shown in FIG. 3), which are formed linearly or obliquely linearly in the holder member 18*a* and the cap member 18*b*. Incidentally, as for the number of the fixing bolt members 18*c* to be inserted obliquely, one bolt member 18*c* is used in the holder member 18*a* and the cap member 18*b* arranged at the foremost part or the backmost part, and two bolt members 18*c* are used in the holder member 18*a* and the cap member 18*b* arranged between the cylinders to which a load heavier than that applied to the member 18*a* and 18*b* arranged at the foremost part or the backmost part is applied (because a load incidental to the variable valve motion is applied to the member 18*a* and 18*b* from both sides).

Furthermore, the shaft displacement detection sensor 16 for detecting the rotational displacement of the control shaft 14 is detachably attached to the sensor attaching boss 31*b* provided on the backmost holder member 18*a* by means of, for example, screws.

That is, in the variable valve unit 4, the variable valve operating mechanism 13, the shaft displacement detection sensor 16, the rocker arm mechanism 17 of the exhaust side, the camshaft 15, and the adjustment mechanism 70 are modularized into a structure by the method in which each part is attached to a frame-like structure having high rigidity constituted of the shafts 14, 34, and 35 and the retaining members 11*a* to 11*c*.

Accordingly, each of the shafts 14, 34, and 35 plays a role of the frame, and hence the retaining members 11*a* to 11*c* can be provided solely at positions where they are required without increasing the size, and the weight of the variable valve unit 4 itself can be minimized.

Further, the shaft displacement detection sensor 16 is positioned so as to be protruded from the cylinder head 1 and the rocker cover 3 to the outside by appropriately setting in advance the cylinder part 31*a* and the sensor attaching boss 31*b*. Thus, when the variable valve unit 4 is accommodated in a space between the cylinder head 1 and the rocker cover 3, the entire assembly other than the shaft displacement detection sensor 16 can be accommodated in the space between the cylinder head 1 and the rocker cover 3, and only the shaft displacement detection sensor 16 is exposed to the outside.

By virtue of such modularization, the variable valve unit 4 becomes a structure in which cylinder-to-cylinder variation can be adjusted singly. Thus, in the variable valve unit 4, cylinder-to-cylinder variation and the sensor output can be adjusted before the mechanism 4 is attached to the cylinder head 1. As a result, in the variable valve unit 4, cylinder-to-cylinder variation and the sensor output is adjusted before the mechanism 4 is attached to the cylinder head 1, and then the mechanism 4 is attached to the cylinder head 1 as shown in FIGS. 2 and 7.

This point will be specifically described below. It is recommended for the variable valve unit 4, modularized before it is attached to the cylinder head 1, to be subjected to adjustment of cylinder-to-cylinder variation and the sensor output on a sub-line separate from the mainline for assembling engines by using a simulation system in which a cylinder head of an engine is simulated.

For example, a modularized variable valve unit 4 is attached to a simulated cylinder head, and a simulated drive apparatus (not shown) is also attached thereto. It is only required to adjust the opening/closing timing and the valve lift amount so as to be uniform and appropriate in the respective cylinders with respect to the target lift by advancing or retreating the screw member 73 of the adjustment mechanism 70 of each cylinder, and attaching the shaft displacement detection sensor 16 so that a signal output conforming to the target lift can be obtained.

The variable valve unit 4 that has been adjusted is transferred by using a jig or a transportation apparatus (both are not shown) as it is so that the adjustment can be maintained so as to be set at a regular position of an actual cylinder head 1 (assembly of a cylinder block is already finished) on the main line for assembling engines, i.e., at module installation seats 94 and 300 (seat surfaces for receiving the seat surface 27: shown in FIGS. 5 to 7), for example, already formed on the top surface 1*y*.

Specifically, both the side parts (including the leg parts 29) of the cap member 18*b* are placed on the module installation seats 94 and 300, and the threaded part 18*d* (formed only at each distal end) of each of the fixing bolt members 18*c* on both sides protruding from parts near both sides of the camshaft 15 is screwed into each of the threaded holes 18*e* (shown in only FIG. 7) formed in the module installation seats 94 and 300.

As a result, the already adjusted variable valve unit 4 is attached to the top surface 1*y* of the cylinder head 1 on the main line. Incidentally, each adjust screw section 42 of the intake side rocker arm 40 is arranged at a stem end of the intake valve 8*a*. Each adjust screw section 83 of the exhaust side rocker arm 80 is arranged at a stem end of the exhaust valve 9*a*.

The installation seat 59 bumps against the installation seat 1*c* (shown in FIGS. 1 and 5) formed on the inner surface of the peripheral wall 1*a* of the cylinder block 1, the entire pusher 57 is supported by the leg section 58, and the swing cam 50 is energized in a direction in which a distal end thereof is forced down.

On the other hand, as shown in FIGS. 1 to 3, a driving source apparatus for driving the variable valve operating mechanism 13, for example, an electrically-driven actuator unit 95 (corresponding to an actuator) is installed at the foremost part of the cylinder head 1.

The electrically-driven actuator unit 95 includes a motor section 96 of a lateral (width direction of the cylinder head 1) type arranged outside the peripheral wall 1*a* of the cylinder head 1, a reduction gear section 97 (for reducing the motor output) connected to the front part of the motor section 96, and a screw shaft 99 connected to the output section of the reduction gear section 97 through a universal joint 98. These are formed into one part as a driving unit.

This electrically-driven actuator unit 95 is attached to the cylinder head 1 in a direction in which the axis thereof intersects the variable valve unit 4 by fixing the leg section 97*b* formed on the casing 97*a* of the reduction gear section 97 to the top surface 1*y* of the cylinder head 1 or the rocker cover attaching seat 1*b* by means of bolts.

In this way, the motor section 96 is caused to protrude toward the outside of the cylinder head 1, and the screw shaft 99 is caused to extend to the arm member 78 end (variable arm mechanism 13) side. That is, the screw shaft 99 extends to the opposite side of the motor section 96.

Incidentally, a part of the peripheral wall 1*a* or the rocker cover 3 at which the electrically-driven actuator unit penetrates the wall 1*a* or the cover 3 is formed into a fan-shaped opening.

A nut member 100 is screw-fitted on the screw shaft 99 so that it can be advanced or retreated. The nut member 100 is constituted of a pin-shaped member having a flange part 100*c* at one end thereof, and having a threaded through hole 100*a* formed in the axial direction thereof at an axis part thereof. The thread hole 100*a* penetrates the nut member 100 in the diameter direction. The threaded hole 100*a* of the nut member is screw-fitted on the screw shaft 99 so that it can be advanced or retreated. This nut member 100 is attached to the distal end of the arm member 78, and the control shaft 14 can be driven by the electrically-driven actuator unit 95.

That is, the nut member 100 is rotatably fitted in a support cylinder 78*a* formed at the distal end of the arm member 78 (variable valve unit 4) and, for example, a C-shaped clip member 100*b* is fitted on the distal end of the nut member 100 so as to allow it to prevent the nut member 100 from slipping off the support cylinder 78*a*, thereby attaching the nut member 100 to the arm member 78.

The part of the screw shaft on both sides of the nut member 100 penetrates a pair of elongated holes formed on both sides of the peripheral wall of the support cylinder 78*a* and extending in the circumferential direction. When the motor section 96 is operated, the screw shaft 99 is rotated, and the nut member 100 is moved along the screw shaft 99 which is swingable. As a result, the arm member 78 is swung, and the control shaft 14 is rotated. In other words, by the driving of the electrically-driven actuator unit 95, the opening/closing timing of the intake valve 8*a* and the valve lift amount can be continuously controlled.

As shown in FIG. 2, the rocker cover 3 is formed into a box-like shape in accordance with the shape of the cylinder head 1. Further, at parts of the peripheral edge of the rocker cover corresponding to the penetration position of the shaft displacement detection sensor 16 and the motor section 96*a*, fan-shaped notch parts 3*a* (only a notch part for the sensor is shown in FIG. 4) for allowing the shaft displacement detection sensor 16 or the motor section 96*a* to penetrate the rocker cover while sealing the penetration parts are formed.

This rocker cover 3 is set on the rocker cover attaching seat 1*b* formed at the peripheral edge of the cylinder head 1 as shown in FIGS. 1 and 4. As a result, of the units and devices to be mounted on the cylinder head 1, the shaft displacement detection sensor 16 and the motor section 96 are exposed to the outside of the rocker cover 3, and the remaining variable valve unit 4, and the greater part of the electrically-driven actuator unit 95 are accommodated in the closed space between the cylinder head 1 and the rocker cover 3.

The shaft displacement detection sensor 16 is exposed to the outside of the rocker cover 3, and hence the shaft displacement detection sensor 16 can be replaced from outside while the rocker cover 3 is closed.

As described above, the variable valve unit 4 becomes a structure in which cylinder-to-cylinder variation and the sensor output can be adjusted singly by modularizing the camshaft 15, the shaft displacement detection sensor 16, and the adjustment mechanism 70. As a result of this, the cylinder-to-cylinder variation adjustment and the sensor output adjustment, which require troublesome operations, can be performed at a place separate from the main line for assembling engines.

Accordingly, the only work required on the main line for engine assembly is that for attaching a variable valve unit 4 for which the cylinder-to-cylinder variation adjustment and the sensor output adjustment have been finished to a cylinder head 1 on the main line. The cylinder-to-cylinder variation adjustment work and the troublesome work for attaching the shaft displacement detection sensor 16, which are regarded as factors in stagnation, are made unnecessary.

Therefore, the productivity of engines can be improved. Moreover, the shaft displacement detection sensor 16 is exposed to the outside of the rocker cover (FIG. 4), and hence, in a completely assembled engine or an engine completed as a product, even when maintenance of the shaft displacement detection sensor 16 is required, it is easily possible to cope with the requirement.

Particularly, the shaft displacement detection sensor 16 can be replaced from outside the rocker cover 3, and the replacement work of the sensor 16 can therefore be easily performed. Even when replacement of the shaft displacement detection sensor 16 is required after the engine is completed as a product, it is possible to quickly cope with the requirement.

Furthermore, the shaft displacement detection sensor 16 for detecting the rotational displacement is arranged at one end of the control shaft 14, whereby the rotational displacement can be directly detected, adjustment accuracy can be enhanced, and accurate control can be enabled.

The other end of the control shaft 14 is coupled to the electrically-driven actuator unit 95, whereby even the elastic torsion of the control shaft 14 caused by valve lift reaction force can be detected as the rotational displacement, and accurate control is enabled.

Moreover, in the variable valve unit 4, modularization including the shaft displacement detection sensor 16 and the arm member 78, which is an actuator coupling member, is enabled, and hence the number of assembly man-hours can be reduced.

Furthermore, by employing the structure in which the holder members 18*a* for holding the one side of the camshaft 15 in the diametric direction, the variable valve operating mechanism 13, the adjustment mechanism 70, and the shaft displacement detection sensor 16, the cap members 18*b* for holding the remaining one side of the camshaft 15, and the fixing bolt members 18*c* penetrating the holder members 18*a* and the cap members 18*b* are combined with each other as the retaining members 11*a* to 11*c*, the fixing bolt members 18*c* used for attachment to the cylinder head 1 can also be used as parts for modularization as they are, and the work for modularization and the adjustment work are performed on the basis of the fixing bolt members 18*c* set as the standard, and hence highly accurate modularization of the variable valve unit 4 and highly accurate adjustment can be performed.

Next, a valve unit of an internal combustion engine according to a second embodiment of the present invention will be described below with reference to FIG. 8. Incidentally, a configuration having the same function as the first embodiment will be denoted by using the same reference symbols as those in the first embodiment, and explanation of them will be omitted.

This embodiment differs from the first embodiment in including a variable valve operating mechanism 200 in place of the variable valve operating mechanism 13. The other part of the structure may be identical to the first embodiment. The point of the second embodiment different from the first embodiment will be specifically described below.

Figure 8:
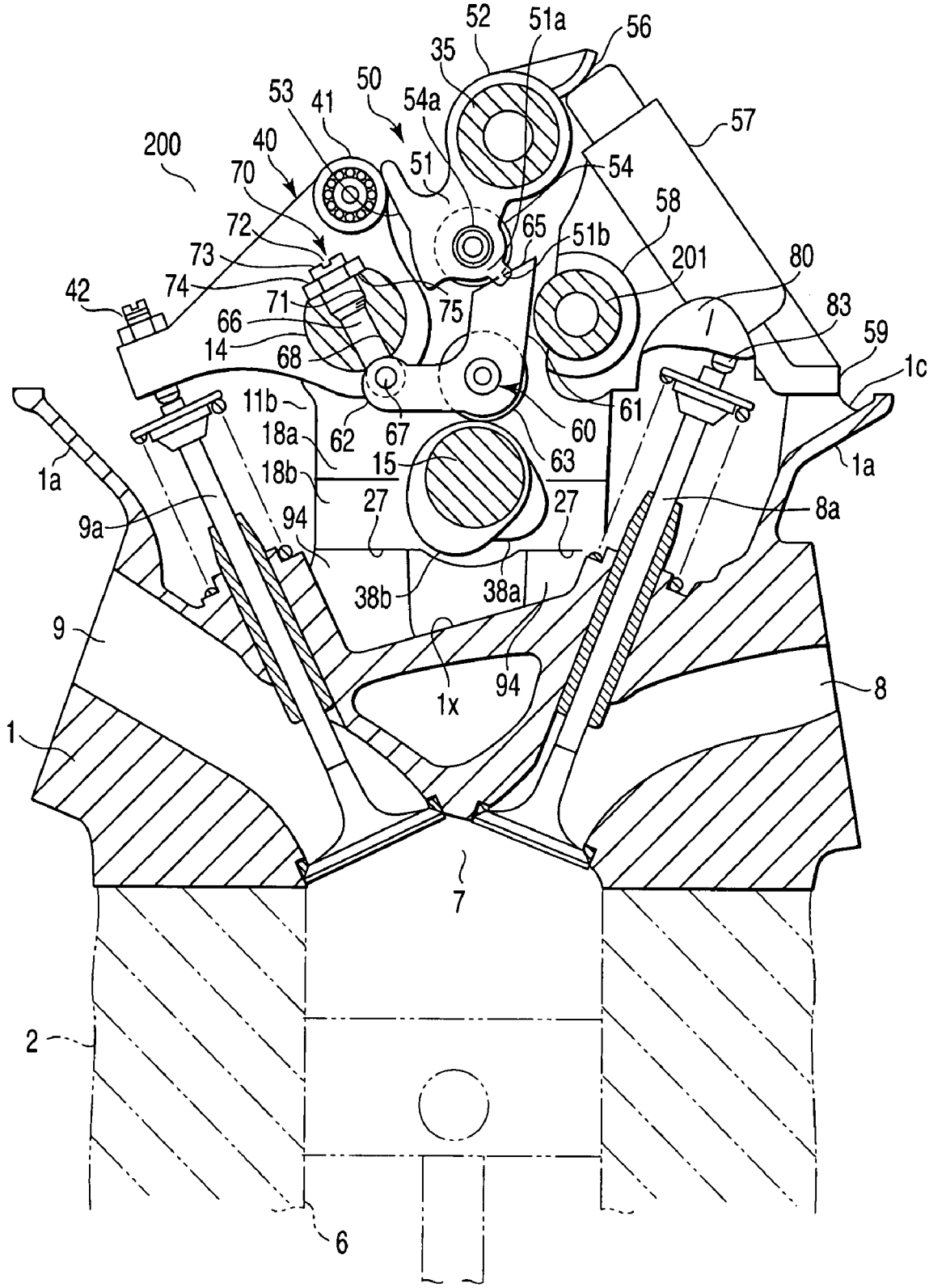
FIG. 8 is a cross-sectional view showing an engine equipped with a valve unit of an internal combustion engine according to a second embodiment of the present invention.

FIG. 8 is a cross-sectional view showing an engine 10 of this embodiment. As shown in FIG. 8, in this embodiment, the engine is provided with the variable valve operating mechanism 200 in place of the variable valve operating mechanism 13. The variable valve operating mechanism 200 has a function of adjusting the opening/closing operation of an exhaust valve 9*a* and not that of an intake valve 8*a*.

The variable valve operating mechanism 200 has a structure in which the intake side and the exhaust side are replaced with each other in the structure of the variable valve operating mechanism 13 described in the first embodiment (accordingly, the configuration having the same function as the first embodiment is denoted by the same reference symbols).

In the variable valve operating mechanism 200, the control shaft 14 doubles as a rocker shaft of the exhaust side. Further, on the intake side, an intake rocker shaft 201 is provided in place of the control shaft 14.

An intake valve rocker arm (not shown) is attached to the intake rocker shaft 201. The intake valve rocker arm drives (opens/closes) the intake valve 8*a*. A structure for driving the intake valve 8*a* in this embodiment may be a mirror image structure of the structure for driving the exhaust valve 9*a* in the first embodiment.

Even when the variable valve operating mechanism 200 has a structure in which driving of the exhaust valve 9*a* can be adjusted as in this embodiment, the same advantage as in the first embodiment can be obtained.

Incidentally, the present invention is not limited to the firs and second embodiments described above, and may be variously modified and implemented within the scope not deviating from the gist of the present invention. For example, the variable valve operating mechanism of the swing cam type is described as an example in the first and second embodiments. The present invention is not limited to this, and a variable valve operating mechanism of another structure may be used.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A valve unit of an internal combustion engine, which is accommodated in a space between a cylinder head of the internal combustion engine and a rocker cover of the internal combustion engine, comprising a camshaft provided with a cam for each cylinder;

a variable valve operating mechanism for receiving a displacement of the cam, outputting a valve drive output, and continuously variable-controlling the valve drive output in accordance with a rotational displacement of a control shaft provided substantially in parallel with the camshaft;

a sensor for detecting the rotational displacement of the control shaft; and a retaining member for retaining the camshaft, the variable valve operating mechanism, and the sensor, and exposing the sensor to the outside of the rocker cover thereby to fix the camshaft, the variable valve operating mechanism, and the sensor to the cylinder head, wherein the sensor for detecting the rotational displacement is arranged at an axial end of the control shaft, and the other end of the control shaft is coupled to an actuator mechanism for rotationally displacing the control shaft.

2. The valve unit of an internal combustion engine according to claim 1, wherein the variable valve operating mechanism comprises an adjustment mechanism capable of adjusting the valve drive output for each cylinder.

3. The valve unit of an internal combustion engine according to claim 1, wherein the retaining member comprises a holder member for holding one side of the camshaft in the diametric direction, the variable valve operating mechanism, and the sensor, a cap member for holding remaining one side of the camshaft, and a fixing bolt member which penetrate the holder member and the cap member, and can be screwed into the cylinder head.

4. The valve unit of an internal combustion engine according to claim 1, wherein the plurality of retaining members are provided so as to axis-support at least both ends of the camshaft and the control shaft, and the retaining members are connected to each other by the camshaft and the control shaft.

5. The valve unit of an internal combustion engine according to claim 3, wherein the plurality of retaining members are provided so as to axis-support at least both ends of the camshaft and the control shaft, and the retaining members are connected to each other by the camshaft and the control shaft.

* * * * *